US011299959B2

(12) United States Patent
Clark et al.

(10) Patent No.: US 11,299,959 B2
(45) Date of Patent: Apr. 12, 2022

(54) PRESSURE BALANCED WELL FLOW CONTROL SYSTEM

(71) Applicant: Eagle PCO, LLC, Navasota, TX (US)

(72) Inventors: Michael Clark, Montgomery, TX (US); Glendell Hendrix, Magnolia, TX (US); Alfred B. Homfeld, Humble, TX (US)

(73) Assignee: Eagle PCO, LLC, Navasota, TX (US)

( * ) Notice: Subject to any disclaimer, the term of this patent is extended or adjusted under 35 U.S.C. 154(b) by 0 days.

(21) Appl. No.: 17/029,093

(22) Filed: Sep. 23, 2020

(65) Prior Publication Data

US 2021/0087911 A1 Mar. 25, 2021

Related U.S. Application Data

(60) Provisional application No. 62/905,482, filed on Sep. 25, 2019.

(51) Int. Cl.

| | |
|---|---|
| ***E21B 34/02*** | (2006.01) |
| ***E21B 34/08*** | (2006.01) |
| *E21B 43/12* | (2006.01) |

(52) U.S. Cl.

CPC ..... *E21B 34/025* (2020.05); *E21B 34/08* (2013.01); *E21B 43/121* (2013.01)

(58) Field of Classification Search

CPC ..... E21B 43/121; E21B 34/08; E21B 43/12; E21B 34/025

See application file for complete search history.

(56) References Cited

U.S. PATENT DOCUMENTS

| | | | | |
|---|---|---|---|---|
| 3,693,732 | A * | 9/1972 | Sabi | E21B 21/08 175/25 |
| 3,827,511 | A * | 8/1974 | Jones | E21B 21/08 175/25 |
| 3,906,726 | A * | 9/1975 | Jameson | E21B 21/08 60/327 |
| 2020/0325742 | A1* | 10/2020 | Astudillo | E21B 21/106 |

* cited by examiner

*Primary Examiner* — Michael R Wills, III
(74) *Attorney, Agent, or Firm* — Richard A. Fagin

(57) ABSTRACT

A pressure balanced well flow control system includes a pressure balanced variable orifice flow control having a controlled flow inlet in fluid communication with a subterranean well and a balance pressure inlet in fluid communication with an outlet end of a fluid pressure isolator. An inlet end of the fluid pressure isolator is in fluid communication with the subterranean well.

8 Claims, 3 Drawing Sheets

PRESSURE BALANCED WELL FLOW CONTROL SYSTEM

CROSS REFERENCE TO RELATED APPLICATIONS

Priority is claimed from U.S. Provisional Application No. 62/905,482 filed on Sep. 25, 2019. The foregoing application is incorporated herein by reference in its entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of subterranean well flow controls. More specifically, the disclosure relates to pressure balanced choke flow controls.

Variable orifice flow controls known as "chokes" are used in construction and testing of subterranean wells. A choke may be used to regulate flow out of such wells, e.g., to maintain a constant flow rate or a constant pressure at a selected depth in a well. A common type of variable orifice choke is a needle valve or knife valve, the opening of which may be controlled manually. The choke may be disposed in a flow line that connects the well to other equipment disposed at the surface. The flow line may be, for example a "choke line" that fluidly connects the well, e.g., in part of a well pressure control device such as a "blowout preventer" (BOP) stack.

Chokes known in the art may become difficult to operate manually in the presence of high well pressure. Although pressure balanced variable orifice valves are known in the art, they have not been widely used because an additional fluid connection between such valve and the well is required to provide the balance pressure. Any additional line connection to a well is discouraged because of the risk of line failure and resulting possible loss of control over well pressure.

Accordingly, there is a need for a pressure balanced valve system that does not increase risk of uncontrolled release of well pressure.

SUMMARY

One aspect of the present disclosure is a pressure balanced well flow control system. The system includes a pressure balanced variable orifice flow control having a controlled flow inlet in fluid communication with a subterranean well and a balance pressure inlet in fluid communication with an outlet end of a fluid pressure isolator. An inlet end of the fluid pressure isolator is in fluid communication with the subterranean well.

In some embodiments, the fluid pressure isolator comprises a piston disposed in a cylinder.

In some embodiments, the cylinder comprises a connector to couple the cylinder directly to a wellhead.

In some embodiments, the piston comprises a seal arranged to close the outlet end of the fluid pressure isolator when the piston is urged against an outlet end of the cylinder.

In some embodiments, the variable orifice flow control comprises a choke.

In some embodiments, the choke comprises a manually operated choke.

In some embodiments, a space between the pressure isolator and the pressure balance inlet is filled with incompressible fluid.

In some embodiments, the incompressible fluid comprises hydraulic oil.

DETAILED DESCRIPTION

Figure 1:
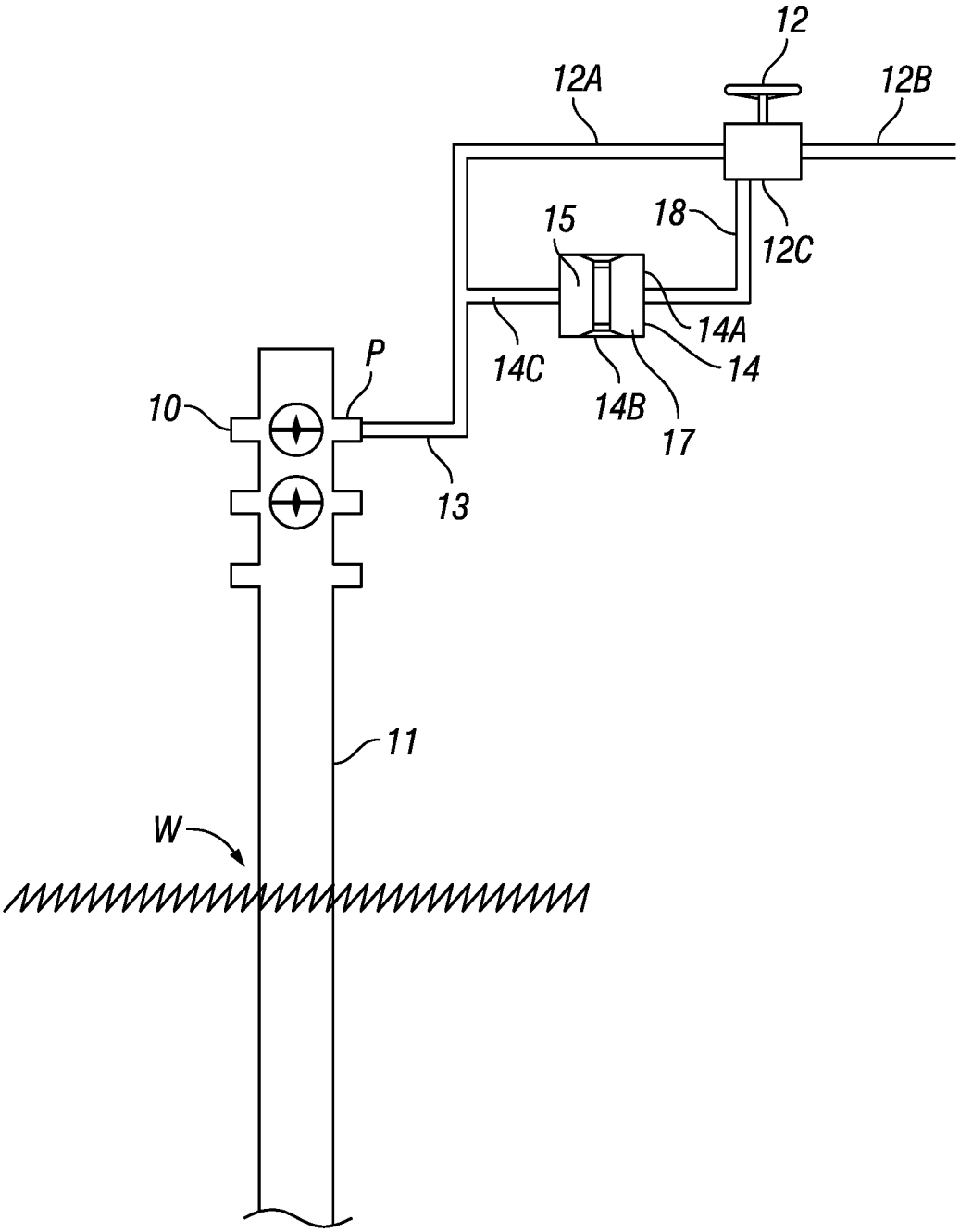
FIG. 1 shows an example embodiment of a pressure balanced choke system according to the present disclosure.

FIG. 1 shows an example embodiment of a pressure balanced well flow control ("choke") system according to the present disclosure. The system may comprise a variable orifice flow control such as a choke 12 fluidly coupled at a controlled flow fluid inlet 12A to a well W, through a fluid line such as a choke line 13. Fluid connection to the well W may be through a suitable fluid port P on a wellhead 10 disposed at an upper end of a well surface casing 11. The schematic drawing in FIG. 1 is for a completed subterranean well. It will be appreciated by those skilled in the art that a similar arrangement may be made with equipment used to construct (drill) a well, e.g., a blowout preventer ("BOP") stack (not shown) coupled to the well surface casing 11. Accordingly, the scope of the present disclosure is not limited to wells under construction or during or after completion. A controlled flow fluid outlet 12B of the choke variable orifice flow control (choke) 12 may be connected to any other surface equipment (not shown) in any manner known in the art.

The variable orifice flow control (choke) 12 may be, for example, a pressure balanced type, i.e., one in which fluid pressure is functionally applied to opposed sides of an actuator to minimize the amount of force needed to operate the actuator. A pressure balance (compensation) inlet 12C of the variable orifice flow control (choke) 12 may be fluidly coupled to one side of a fluid pressure isolator (e.g., a compensator or transducer) 14. The other side of the fluid pressure isolator 14 may be fluidly coupled to the well W. In the present example embodiment, the fluid pressure isolator's 14 fluid connection to the well W may be made through the choke line 13. In other embodiments, the fluid pressure isolator 14 may be fluidly coupled to the well W directly to the wellhead 10 or to a BOP stack (not shown in FIG. 1), either through a valve (not shown) or without such valve.

In some embodiments, the fluid pressure isolator 14 may comprise a piston 14B disposed in a cylinder 14A, suitably sealed to the cylinder 14A, to prevent movement of fluid across or by the piston 14B. The choke side of the piston 14B (i.e., the outlet side of the fluid pressure isolator 14) may be fluidly coupled to the choke's 12 pressure balance inlet 12C through an hydraulic line 18. The hydraulic line 18 and the cylinder 14A on the same side of the piston 14B may be completely filled with substantially incompressible fluid 17 such as hydraulic oil. The other side (i.e., the inlet side of the fluid pressure isolator 14) of the piston 14B and corresponding volume within the cylinder 14A may be exposed to well fluid 15, which will be under pressure equal to fluid pressure in the well W. The piston 14B is free to move within the cylinder 14A and thereby communicate well fluid pressure from the well W to the pressure balance inlet 12C. Thus, fluid pressure at the pressure balance inlet 12C will be equal at all times to the pressure in the well fluid 15, and thereby the pressure in the well W.

In the event the hydraulic line 18 fails, fluid pressure in the hydraulic line 18 will be lost. The piston 14B will then be urged against the corresponding end of the cylinder 14A by well fluid 15 pressure. The hydraulic line side of the piston 14B may comprise one or more seals (not shown separately) to effectively close such end of the cylinder 14A to fluid flow in such event. Thus, failure of the hydraulic line 18 will not result in uncontrolled release of well fluid 15 from the fluid pressure isolator 14.

Figure 2:
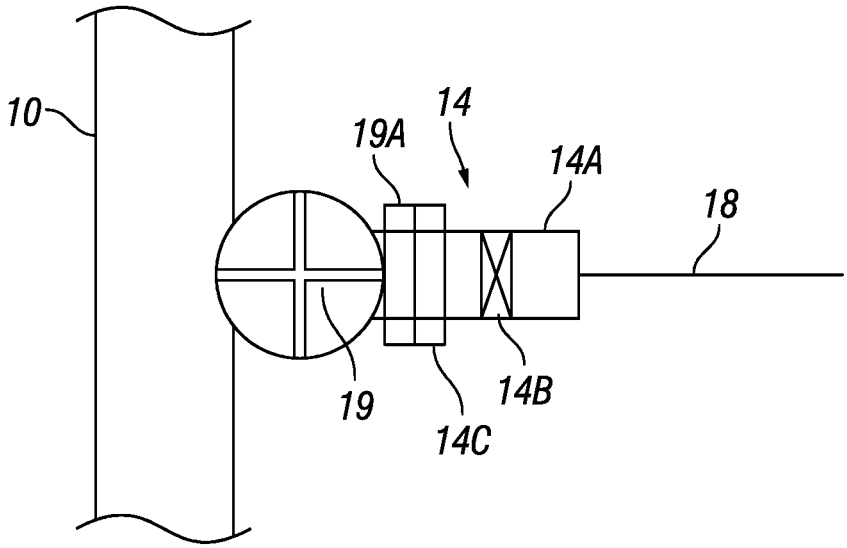
FIG. 2 shows an example embodiment of a well fluid pressure isolator.

FIG. 2 shows another example embodiment of the fluid pressure isolator 14. The cylinder 14A in FIG. 2 may comprise a coupling 14C such as a flange or compression union on the end that makes direct fluid connection to the well W, e.g., to the wellhead 10 (or BOP stack). A corresponding coupling may form part of, for example, a wing valve 19 coupled to the wellhead 10 (or BOP stack). The embodiment of FIG. 2 may eliminate the need for a separate pressure reference line or connection (e.g., at 14C in FIG. 1) from the well side of the piston 14B into the choke line (13 in FIG. 1) in order to apply well fluid pressure to the well side of the piston 14B. By eliminating the pressure reference line (14C in FIG. 1) a possible hazard may be eliminated by deleting an exposed hydraulic line or hose at well pressure.

Figure 3:
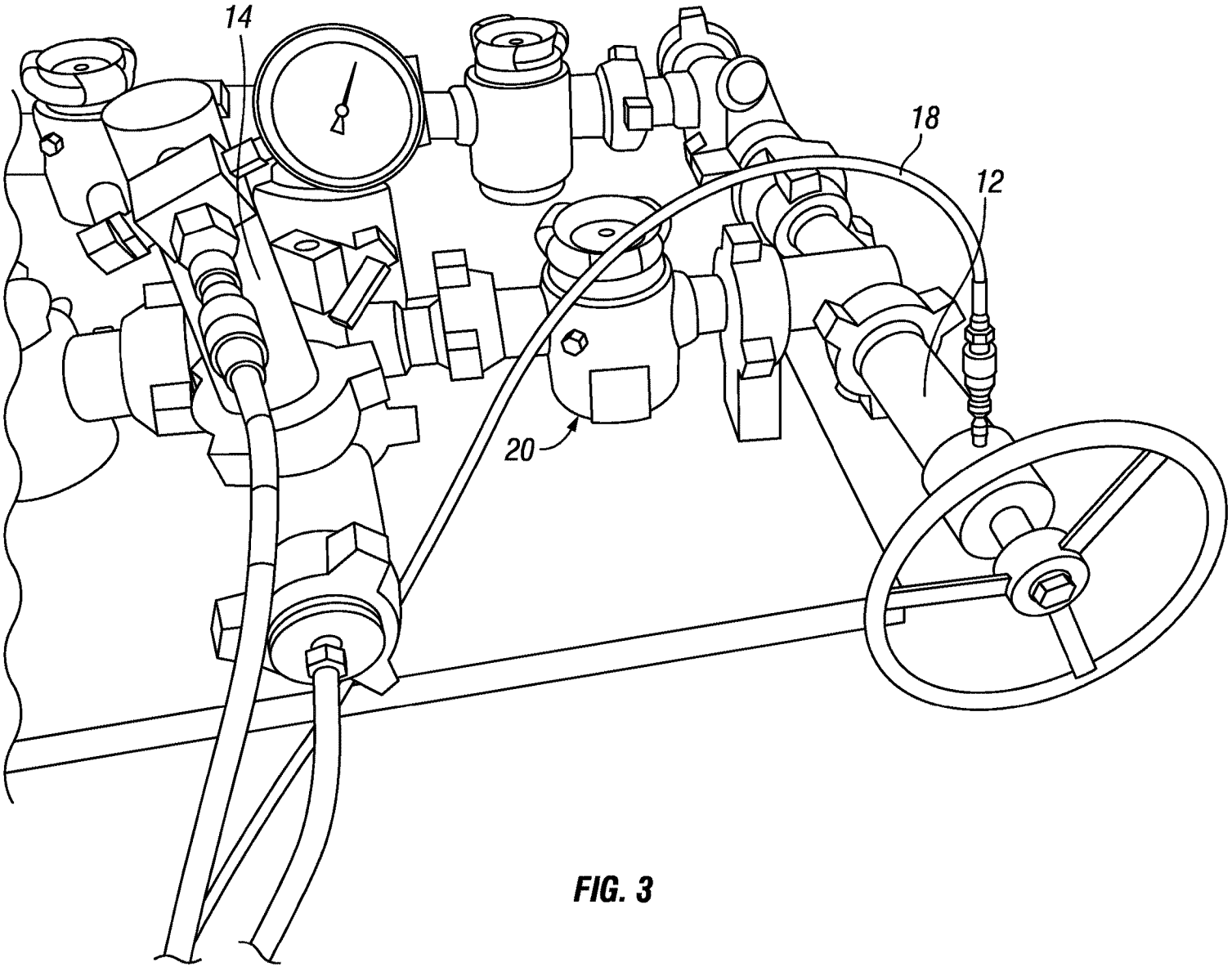
FIG. 3 shows an example embodiment of the fluid pressure isolator used in connection with a choke manifold.

Another example embodiment is shown in FIG. 3. The cylinder (14A in FIG. 2) in which the pressure transducer 14 is disposed may be coupled directly to a choke manifold 20. The choke manifold 20 makes fluid connection from the choke 12 inlet (12A in FIG. 1) to the wellhead (10 in FIG. 1). A hydraulic line 18 makes fluid connection from the choke side of the piston (14B in FIG. 2) to the compensator inlet (12C in FIG. 1). As with the embodiment shown in FIG. 2, failure of the hydraulic line 18 will result in movement of the piston (14B in FIG. 2) to close the outlet of the cylinder 14A thereby preventing loss of well pressure.

A pressure balanced well flow control system according to the present disclosure may enable the use of manually operated flow controls such as chokes with minimum operating force and reduced risk of uncontrolled escape of well fluid under pressure. While the present disclosure is made with reference to manually operated variable orifice chokes, it will be appreciated by those skilled in the art that the principle of a system according to the present disclosure is also applicable to power operated variable orifice flow controls. In such circumstances, the size and power needed to operate an actuator may be reduced in contrast to that needed for unbalanced flow controls.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A pressure balanced well flow control system, comprising: a pressure balanced variable orifice flow control having a controlled flow inlet in fluid communication with a subterranean well and a balance pressure inlet in fluid communication with an outlet end of a fluid pressure isolator; and wherein an inlet end of the fluid pressure isolator is in fluid communication with the subterranean well, the fluid pressure isolator comprising a piston disposed in a cylinder for communicating pressure in the subterranean well to the balance pressure inlet such that a pressure at the pressure balance inlet is at all times equal to the pressure in the subterranean well.

2. The system of claim 1 wherein the cylinder comprises a connector to couple the cylinder directly to a wellhead, whereby pressure in the subterranean well is communicated to the fluid pressure isolator without using an exposed hydraulic line or an exposed hydraulic hose.

3. The system of claim 1 wherein the cylinder is coupled to a choke manifold.

4. The system of claim 1 wherein the piston comprises a seal on an outlet end side thereof arranged to close the outlet end of the fluid pressure isolator only when the piston is urged against an outlet end of the cylinder.

5. The system of claim 1 wherein the variable orifice flow control comprises a choke.

6. The system of claim 5 wherein the variable orifice choke comprises a manually operated choke.

7. The system of claim 1 wherein a space between the pressure isolator and the pressure balance inlet is filled with incompressible fluid.

8. The system of claim 7 wherein the incompressible fluid comprises hydraulic oil.

* * * * *